US009630435B1

(12) United States Patent
Shih

(10) Patent No.: US 9,630,435 B1
(45) Date of Patent: Apr. 25, 2017

(54) STAMP HAVING PRINTING ASSEMBLY WITH INK-FILLING MEMBER

(71) Applicant: Sun Same Enterprises Co., Ltd., Tainan (TW)

(72) Inventor: Wen-Jer Shih, Tainan (TW)

(73) Assignee: Sun Same Enterprises Co., Ltd. (TW)

( * ) Notice: Subject to any disclaimer, the term of this patent is extended or adjusted under 35 U.S.C. 154(b) by 0 days.

(21) Appl. No.: 14/996,405

(22) Filed: Jan. 15, 2016

(51) Int. Cl.

| | |
|---|---|
| ***B41K 1/38*** | (2006.01) |
| ***B41K 1/52*** | (2006.01) |
| ***B41K 1/40*** | (2006.01) |
| ***B41K 1/56*** | (2006.01) |

(52) U.S. Cl.
CPC ..... *B41K 1/40* (2013.01); *B41K 1/52* (2013.01); *B41K 1/56* (2013.01)

(58) Field of Classification Search
CPC ... B41K 1/02; B41K 1/36; B41K 1/38; B41K 1/40; B41K 1/52; B41K 1/54
USPC ..... 101/327, 333, 334
See application file for complete search history.

(56) References Cited

U.S. PATENT DOCUMENTS

| | | | | |
|---|---|---|---|---|
| 5,855,170 | A * | 1/1999 | Shih | B41K 1/52 101/327 |
| 6,189,450 | B1 * | 2/2001 | Shih | B41K 1/52 101/125 |
| 6,499,398 | B2 * | 12/2002 | MacNeil | B41K 1/50 101/327 |
| 2010/0251912 | A1 * | 10/2010 | Feilecker | B41K 1/02 101/333 |
| 2013/0312627 | A1 * | 11/2013 | Zehetner | B41K 1/38 101/333 |

* cited by examiner

*Primary Examiner* — Leslie J Evanisko
(74) *Attorney, Agent, or Firm* — Lerner, David, Littenberg, Krumholz & Mentlik, LLP

(57) ABSTRACT

A stamp has a retaining seat, a moving seat, a spring, a handle, and a bottom cover. The moving seat is moveably mounted in the retaining seat. The spring is mounted on the moving seat and abuts the retaining seat. The handle is mounted on the moving seat and extends around the retaining seat. The bottom cover is mounted on a bottom of the retaining seat. The moving seat has a printing assembly and an ink-filling member. The printing assembly has a printing face and multiple ink-filling holes. The ink-filling member is mounted on the printing assembly and has multiple ink-filling tubes. Each one of the ink-filling tubes has a caliber smaller than a caliber of each one of the ink-filling holes. The printing assembly may perform the test print. The combining time of the stamp and operating time of the test print are also decreased.

16 Claims, 8 Drawing Sheets

STAMP HAVING PRINTING ASSEMBLY WITH INK-FILLING MEMBER

BACKGROUND OF THE INVENTION

1. Field of the Invention

The present invention relates to a stamp, and more particularly to an ink-refillable stamp.

2. Description of Related Art

A conventional stamp has a retaining seat, a moving seat, a spring, a handle, and a bottom cover. The moving seat is moveably mounted in the retaining seat. The spring is mounted on the moving seat. Two ends of the spring are respectively connected to the moving seat and the retaining seat. The handle is mounted on the moving seat and extends around the retaining seat. The bottom cover is mounted on a bottom of the retaining seat.

Furthermore, the moving seat of the conventional stamp has a bottom body, a printing element, and a top body. The bottom body has a bottom plate portion, an opening, a side plate portion, and multiple connecting holes. The opening is formed through the bottom plate portion of the bottom body. The side plate portion is formed on the bottom body around the bottom plate portion. The connecting holes are formed on the side plate portion. The printing element is mounted on the bottom body and has a block and an ink-absorbing layer. The block is mounted on the bottom plate portion and has a printing face protruding out of the opening of the bottom body. The ink-absorbing layer is mounted on the block.

The top body is mounted on the bottom body. The top body has a top plate portion, multiple ink-filling tubes, a wall, and multiple convex portions. The top plate portion of the top body is located on the printing element. The ink-filling tubes are formed on the top plate. The wall is formed on the top body around the top plate and extends into the bottom body. The convex portions are formed on the wall and are respectively inserted into the connecting holes of the bottom body.

The printing face of the block of the conventional stamp is exposed and etched in the factory, and then the printing face of the block is assembled between the bottom body and the top body of the conventional stamp. Ink is filling into the ink-absorbing layer via the ink-filling tubes. Then, the moving seat is to test print. If the result of the test print is good, the moving seat is further combined with the retaining seat, the spring, the handle, and the bottom cover, and then the conventional stamp can be shipped. Since a caliber of each one of the ink-filling tubes is small and the waiting time for the osmosis of the ink-absorbing layer is long, the operating time in the factory is increased.

To overcome the shortcomings, the present invention tends to provide a stamp to mitigate or obviate the aforementioned problems.

SUMMARY OF THE INVENTION

The main objective of the invention is to provide a stamp that may decrease the waiting time for the osmosis of the ink-absorbing layer in the test print.

The stamp has a retaining seat, a moving seat, a spring, a handle and a bottom cover. The moving seat is moveably mounted in the retaining seat. The spring is mounted on the moving seat and abuts the retaining seat. The handle is mounted on the moving seat and extends around the retaining seat. The bottom cover is mounted on a bottom of the retaining seat.

The moving seat has a printing assembly and an ink-filling member. The printing assembly has a bottom frame, a printing element and a top frame. The bottom frame has a bottom surface, an outer surface, an opening and multiple first connecting portions. The outer surface of the bottom frame is formed around the bottom surface of the bottom frame. The opening is formed through the bottom surface of the bottom frame. The first connecting portions are formed on the outer surface of the bottom frame at spaced intervals. The printing element is mounted in the bottom frame and has a printing face. The printing face is formed on the printing element and extends out of the bottom frame via the opening of the bottom frame. The top frame is mounted on the bottom frame and has a top surface, an outer surface, multiple ink-filling holes, multiple second connecting portions, and multiple third connecting portions. The outer surface of the top frame is formed around the top surface of the top frame.

The ink-filling holes are formed on the top surface of the top frame above the printing element and each one of the ink-filling holes has a caliber. The second connecting portions are formed on and protrude from the outer surface of the top frame and respectively engage with the first connecting portions of the bottom frame. The third connecting portions are formed on the outer surface of the top frame at spaced intervals. The ink-filling member is mounted on the printing assembly and has a top surface, an outer surface, multiple fourth connecting portions and multiple ink-filling tubes. The outer surface of the ink-filling member is formed around the top surface of the ink-filling member. The fourth connecting portions are formed on the outer surface of the ink-filling member and respectively engage with the third connecting portions of the top frame. The ink-filling tubes are formed on and protrude from the top surface of the ink-filling member above the ink-filling holes and are in communication with the ink-filling holes of the printing assembly. Each one of the ink-filling tubes has a caliber smaller than the caliber of each one of the ink-filling holes.

The printing face of the printing element of the stamp may be exposed and etched in the factory or the store. The printing element is mounted on the bottom frame, and then the top frame is mounted on the bottom frame to fix the printing element and finish the combination of the printing assembly. Ink can be filled into the printing assembly to test print. If the result of the test print is good, users can further combine the printing assembly with the ink-filling member, the retaining seat, the spring, the handle, and the bottom cover. The caliber of each one of the ink-filling holes is larger than the caliber of each one of the ink-filling tubes. The osmosis efficiency of ink filled via the ink-filling holes is better than the osmosis efficiency of ink filled via the ink-filling tubes. Therefore, the printing assembly may perform the test print. The waiting time for the osmosis of the ink-absorbing layer is decreased. The combining time of the stamp and the operating time of the test print are also decreased.

DETAILED DESCRIPTION OF PREFERRED EMBODIMENT

Figure 1:
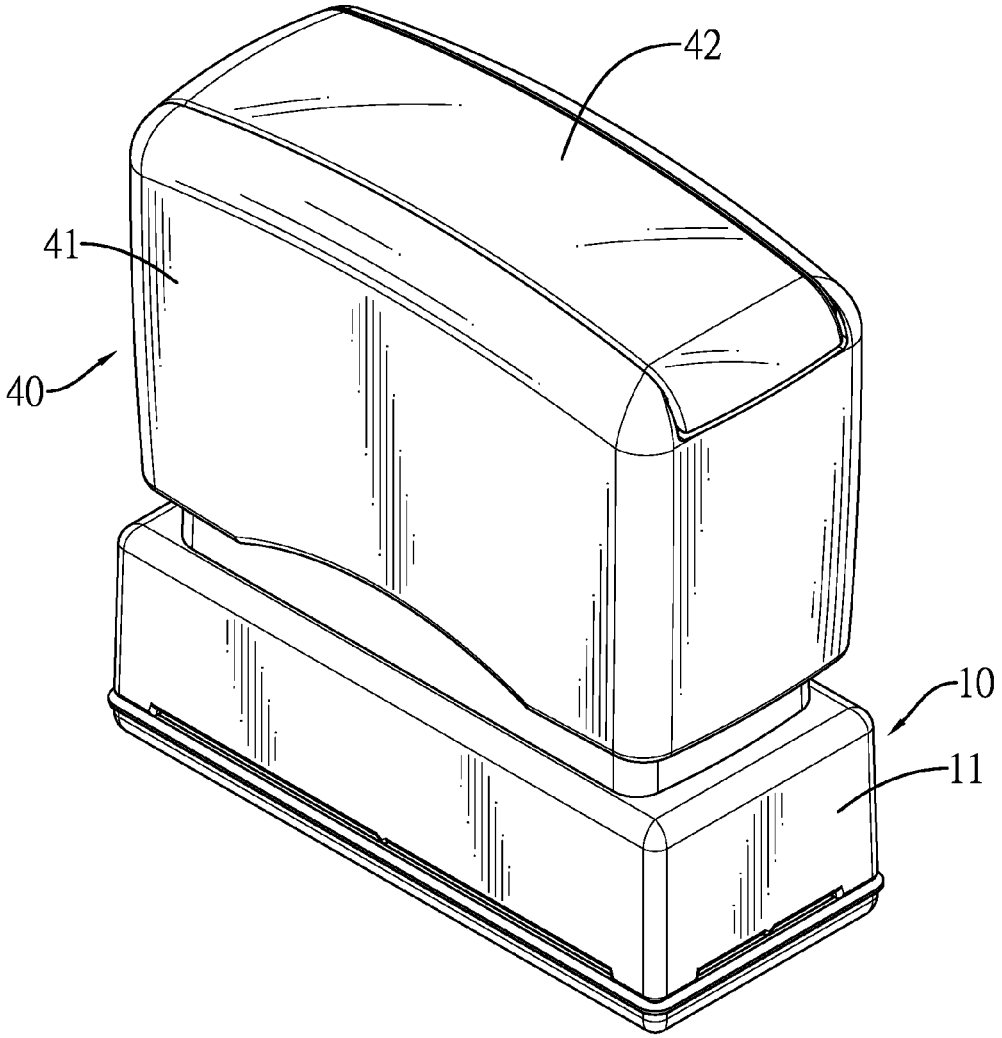
FIG. 1 is a perspective view of a stamp in accordance with the present invention.
Figure 2:
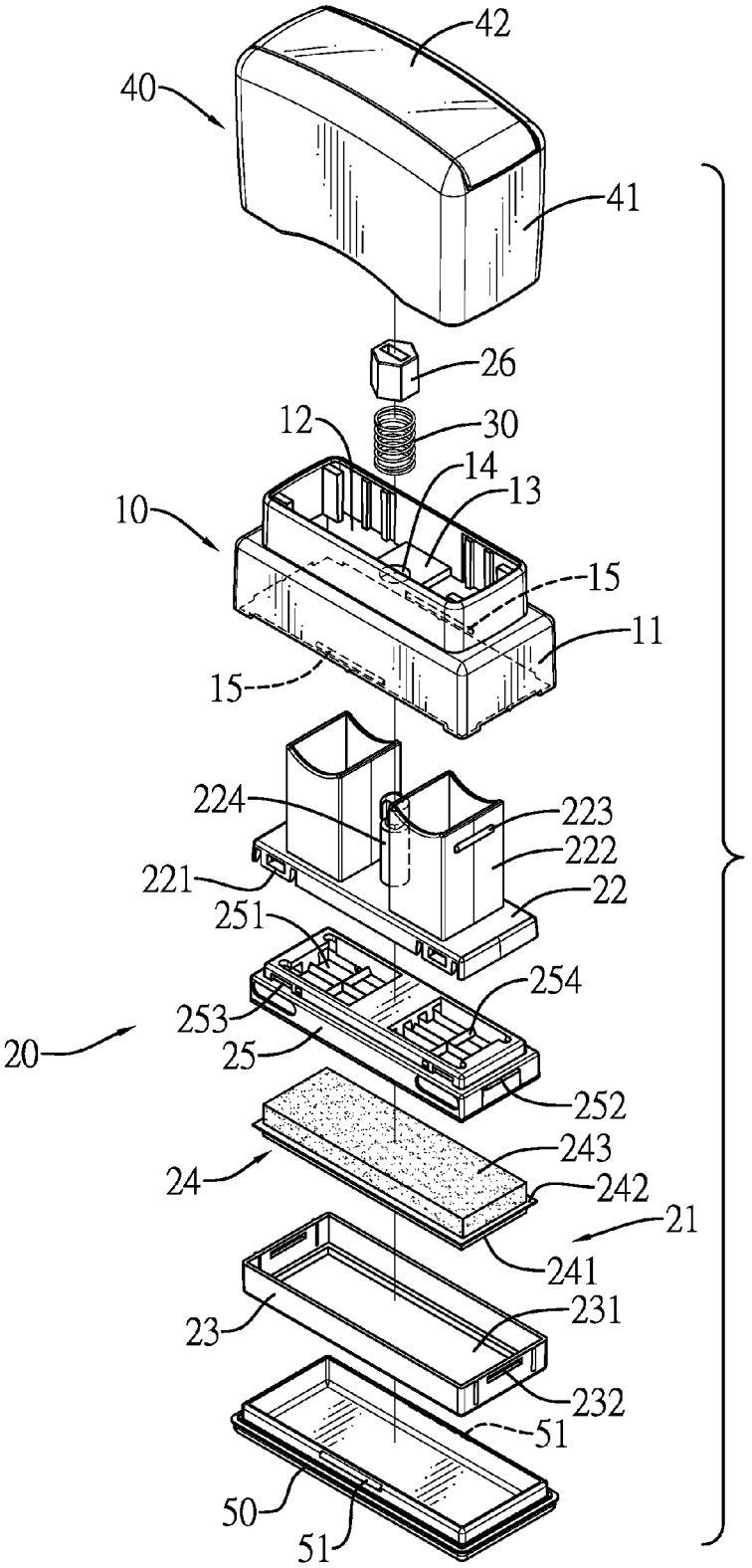
FIG. 2 is an exploded perspective view of the stamp in FIG. 1.
Figure 3:
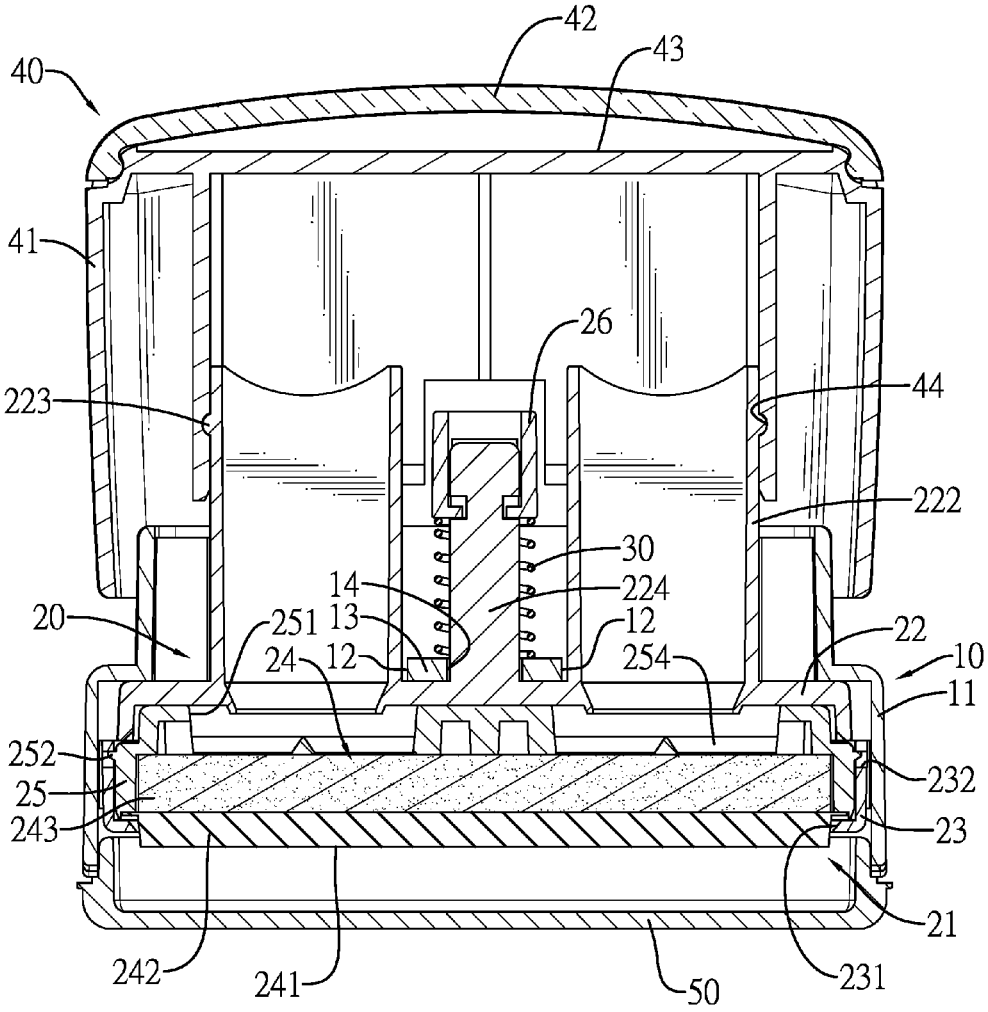
FIG. 3 is an enlarged cross-sectional side view of the stamp in FIG. 1.

With reference to FIGS. 1 to 3, a stamp in accordance with the present invention comprises a retaining seat 10, a moving seat 20, a spring 30, a handle 40, and a bottom cover 50.

The retaining seat 10 has a shell 11, multiple gateways 12, a plate 13, and a through hole 14. The gateways 12 are formed through the shell 11. The plate 13 is formed in the shell 11 and is located between the gateways 12. The through hole 14 is formed through the plate 13. In addition, the shell 11 has two inner sides and two first engaging portions 15. The two inner sides of the shell 11 face each other. The first engaging portions 15 are respectively formed on the two inner sides of the shell 11.

The moving seat 20 is moveably mounted in the retaining seat 10. The moving seat 20 has a printing assembly 21 and an ink-filling member 22. The printing assembly 21 has a bottom frame 23, a printing element 24, and a top frame 25. The bottom frame 23 has a bottom surface, an outer surface, an opening 231, and multiple first connecting portions 232. The outer surface of the bottom frame 23 is formed around the bottom surface of the bottom frame 23. The opening 231 is formed through the bottom surface of the bottom frame 23. The first connecting portions 232 are formed on the outer surface of the bottom frame 23 at spaced intervals.

Figure 4:
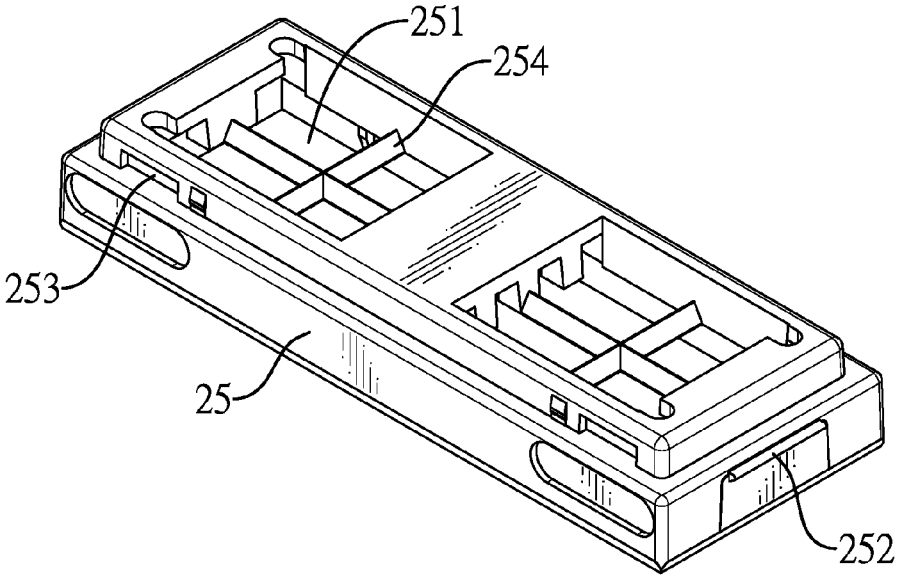
FIG. 4 is an enlarged perspective view of a first embodiment of a top frame of the stamp in FIG. 1.

The printing element 24 is mounted in the bottom frame 23 and has a printing face 241. The printing face 241 is formed on the printing element 24 and extends out of the bottom frame 23 via the opening 231. The top frame 25 is mounted on the bottom frame 23. With reference to FIGS. 3 and 4, the top frame 25 has a top surface, an outer surface, multiple ink-filling holes 251, multiple second connecting portions 252, and multiple third connecting portions 253. The outer surface of the top frame 25 is formed around the top surface of the top frame 25. The ink-filling holes 251 are formed in the top surface of the top frame 25 above the printing element 24, and each one of the ink-filling holes 251 has a caliber. The second connecting portions 252 are formed on and protrude from the outer surface of the top frame 25 and respectively engage with the first connecting portions 232 of the bottom frame 23 to connect the top frame 25 with the bottom frame 23. The third connecting portions 253 are formed on the outer surface of the top frame 25 at spaced intervals.

Figure 5:
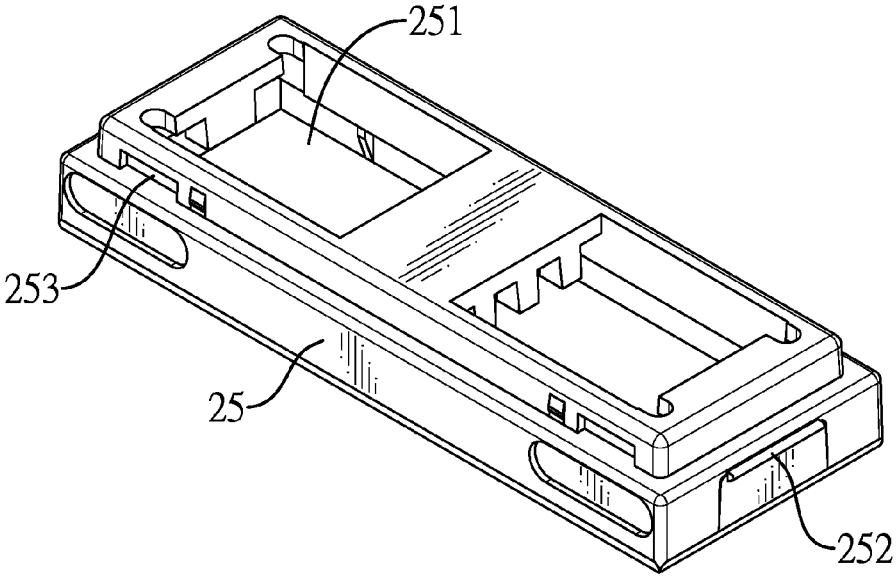
FIG. 5 is an enlarged perspective view of a second embodiment of the top frame of the stamp in FIG. 1.
Figure 9:
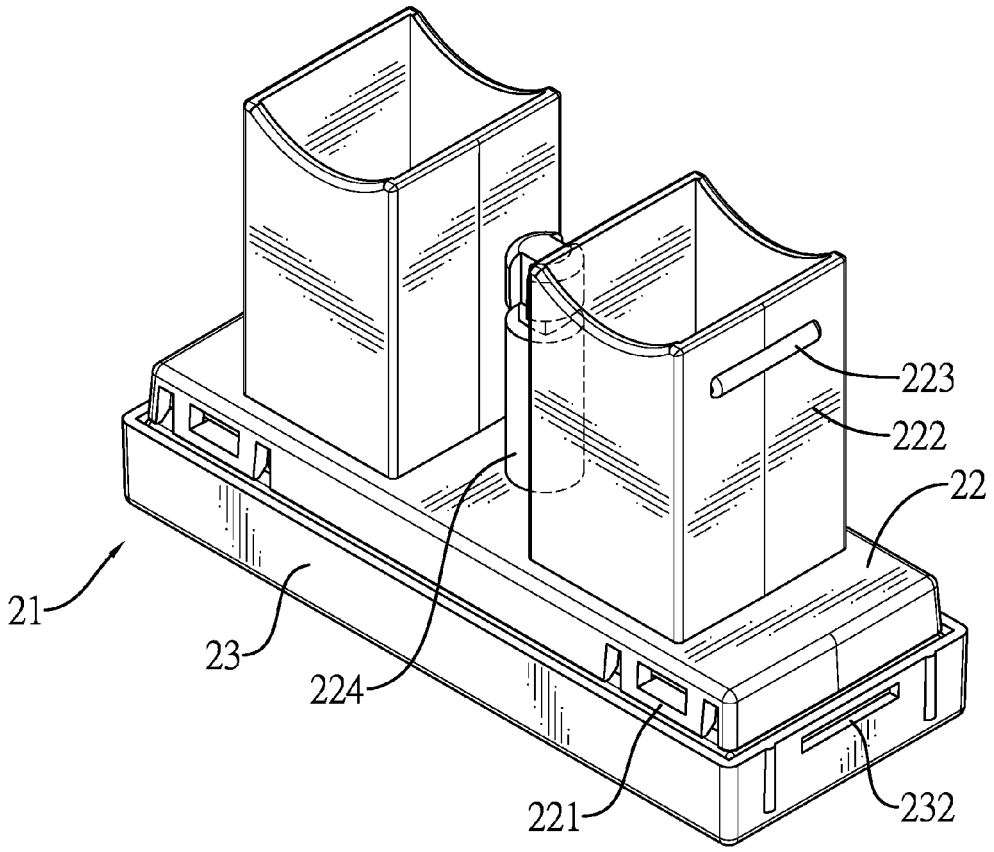
FIG. 9 is an enlarged perspective view of a moving seat of the stamp in FIG. 2.
Figure 10:
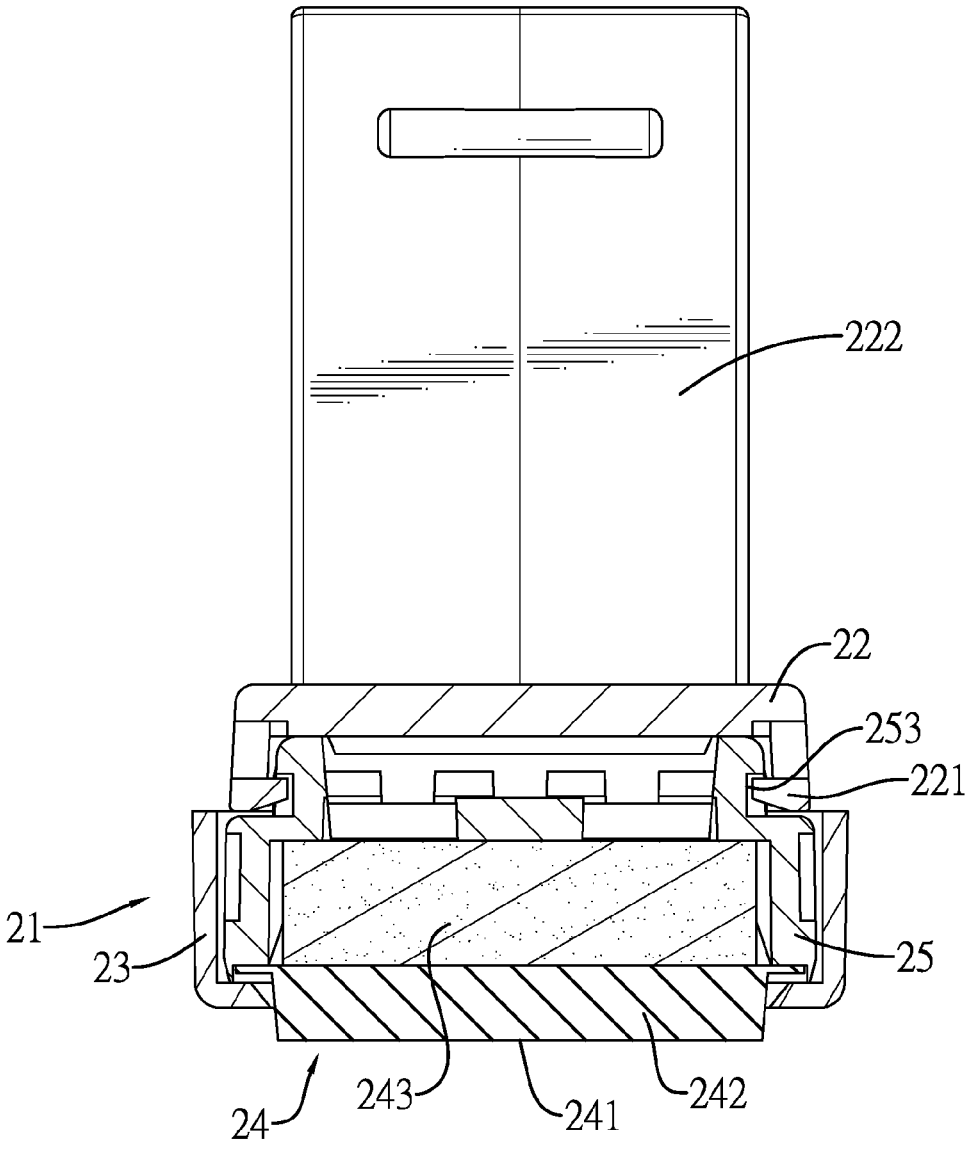
FIG. 10 is a cross-sectional side view of the moving seat of the stamp in FIG. 9.

With reference to FIGS. 2, 9, and 10, the ink-filling member 22 is mounted on the printing assembly 21. The ink-filling member 22 has a top surface, an outer surface, multiple fourth connecting portions 221, and multiple ink-filling tubes 222. The outer surface of the ink-filling member 22 is formed around the top surface of the ink-filling member 22. The fourth connecting portions 221 are formed on the outer surface of the ink-filling member 22 and respectively engage with the third connecting portions 253 of the top frame 25 to connect the ink-filling member 22 with the top frame 25. The ink-filling tubes 222 are formed on and protrude from the top surface of the ink-filling member 22 above the ink-filling holes 251 and are respectively in communication with the ink-filling holes 251 of the printing assembly 21. Each one of the ink-filling tubes 222 has a caliber. The caliber of each one of the ink-filling tubes 222 is smaller than the caliber of each one of the ink-filling holes 251. Each one of the ink filling tubes 222 has an outer side and a convex portion 223. The two outer sides of the ink-filling tubes 222 are opposite to each other. The convex portions 223 of the ink filling tubes 222 are respectively formed on the two outer sides of the ink-filling tubes 222. With reference to FIG. 4, in a first embodiment of the top frame 25, the top frame 25 has two reinforcing ribs 254. The multiple reinforcing ribs 254 are respectively deposited in the ink-filling holes 251 of the top frame 25. With reference to FIG. 5, in a second embodiment of the top frame 25, the top frame 25 does not have any reinforcing rib 254 deposited in the ink-filling holes 251 of the top frame 25.

Figure 6:
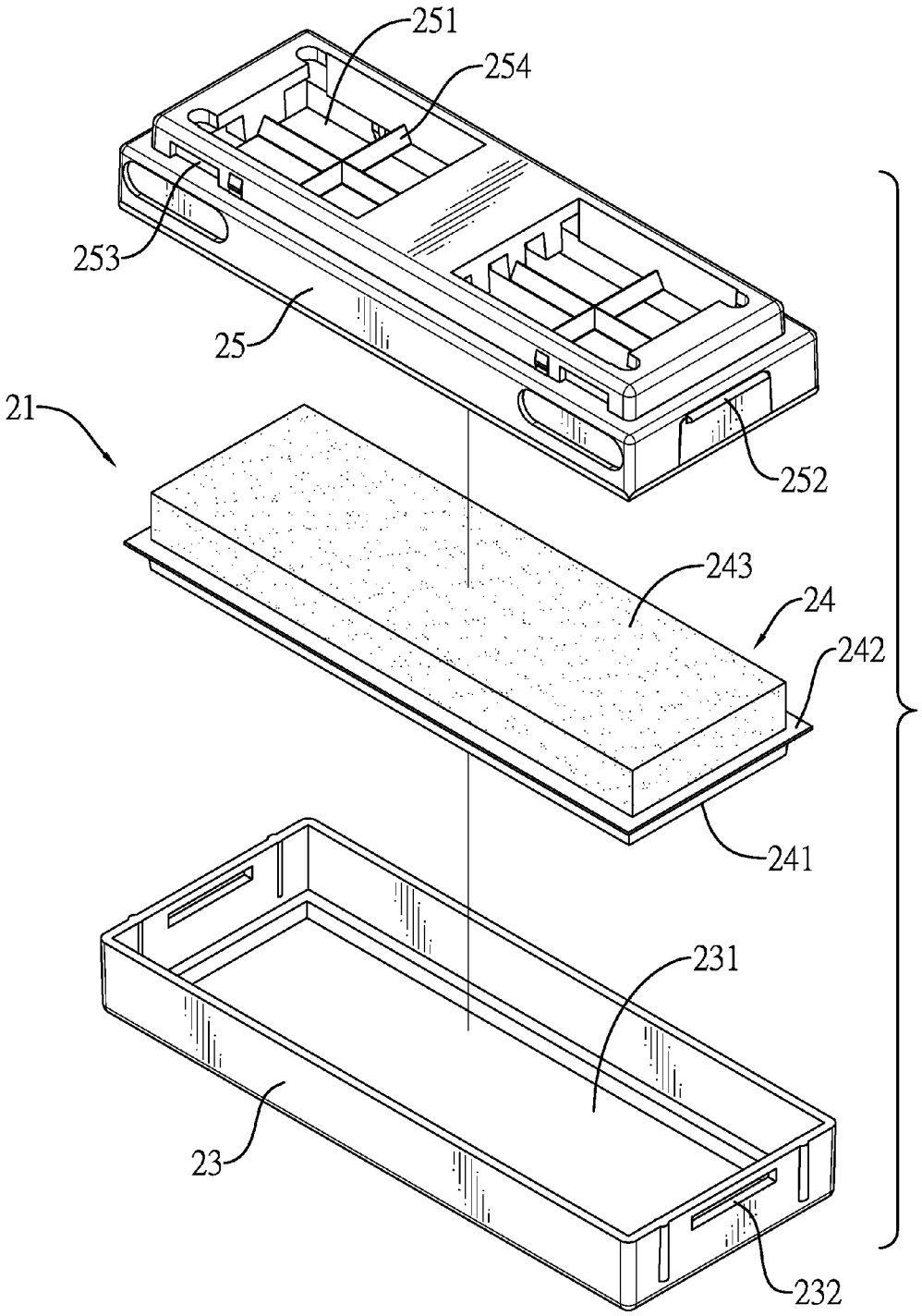
FIG. 6 is an exploded perspective view of a printing assembly of the stamp in FIG. 1.
Figure 8:
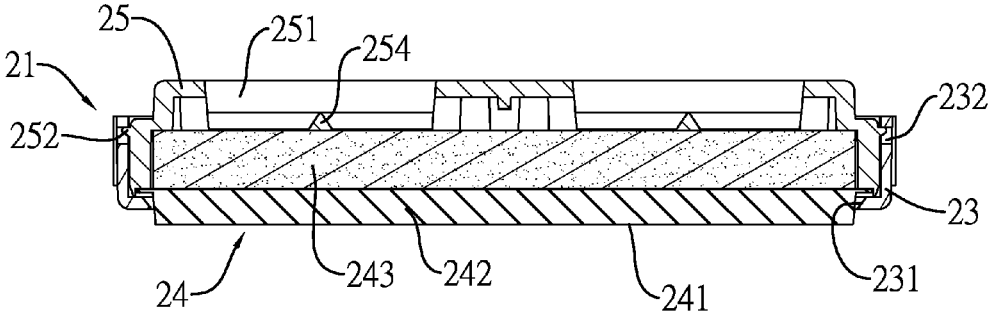
FIG. 8 is a cross-sectional side view of the printing assembly of the stamp in FIG. 7.

The ink-filling tubes 222 of the ink-filling member 22 are respectively inserted through the gateways 12 of the retaining seat 10. The ink-filling member 22 has a cylinder 224 and a retainer 26. The cylinder 224 is formed on the top surface of the ink-filling member 22 between the ink-filling tubes 222 and is inserted through the through hole 14 of the retaining seat 10. The retainer 26 is mounted on a distal end of the cylinder 224. With reference to FIGS. 6 and 8, the printing element 24 has a block 242 and an ink-absorbing layer 243. The block 242 is mounted on the bottom frame 23, faces the opening 231, and has a top surface and a bottom surface. The bottom surface of the block 242 extends out of the bottom frame 23 via the opening 231 as shown in FIGS. 3 and 8. The ink-absorbing layer 243 is mounted on the top surface of the block 242 and faces the ink-filling holes 251 of the top frame 25. The printing face 241 is formed on the bottom surface of the block 242.

The spring 30 is mounted on the moving seat 20 and abuts the retaining seat 10. The spring 30 is further mounted around the cylinder 224 and has two ends. The two ends of the spring 30 respectively abut the plate 13 of the retaining seat 10 and the retainer 26 of the ink-filling member 22 to provide an elastic force to the ink-filling member 22.

With reference to FIGS. 1 to 3, the handle 40 is mounted on the moving seat 20 and extends around the retaining seat 10. The handle 40 has a body 41 and a top cover 42. The body 41 is mounted on the moving seat 20 and has a top surface and a concavity 43. The concavity 43 is formed on the top surface of the body 41. The top cover 42 is mounted on the body 41 and covers the concavity 43 of the body 41. The handle 40 has two inner surfaces and two recesses 44. The two inner surfaces of the handle 40 are opposite to each other. The recesses 44 are respectively formed on the two inner surfaces of the handle 40. The convex portions 223 of the ink-filling tubes 222 are respectively inserted into the recesses 44 of the handle 40 to connect the handle 40 with the moving seat 20. In addition, the top cover 42 is transparent.

The bottom cover 50 is mounted on a bottom of the retaining seat 10. The bottom cover 50 has two side surfaces and two second engaging portions 51. The two side surfaces of the bottom cover 50 are opposite to each other. The second engaging portions 51 are respectively formed on the side surfaces of the bottom cover 50. The second engaging portions 51 respectively engage with the first engaging portions 15 of the shell 11.

Figure 7:
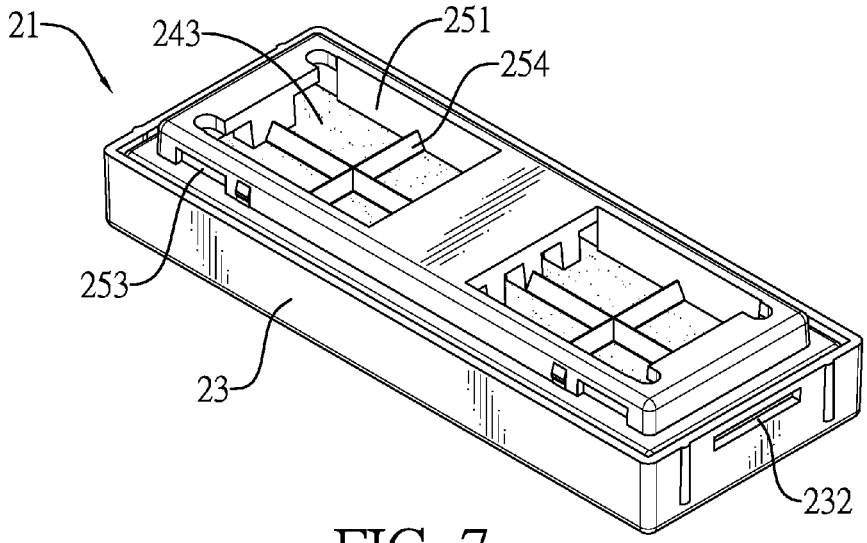
FIG. 7 is an enlarged perspective view of the printing assembly of the stamp in FIG. 2.

In the factory or the store, the printing face 241 of the printing element 24 may be exposed and etched by users. With reference to FIGS. 6 to 8, the print element 24 after exposing and etching is mounted on the bottom frame 23. The printing face 241 of the print element 24 is inserted through the opening 231 and extends out of the bottom frame 23. The top frame 25 is mounted on the bottom frame 23. The second connecting portions 252 of the top frame 25 engage with the first connecting portions 232 of the bottom frame 23 respectively to connect the top frame 25 with the bottom frame 23. Then, the printing element 24 is fixed between the top frame 25 and the bottom frame 23. The combination of the printing assembly 21 is finished.

After combination, the printing assembly 21 may be used to test print by users. Ink may be filled into the ink-absorbing layer 243 of the printing element 24 via the ink-filling holes 251 of the top frame 25. The caliber of each one of the ink-filling holes 251 of the top frame 25 is larger than the caliber of each one of the ink-filling tubes 222 of the ink-filling member 22. Ink is quickly infiltrated into the ink-absorbing layer 243 of the printing element 24 for providing convenience to test print.

If the result of the test print is good, users can go on to finish the combination of the stamp. With reference to FIGS. 9 and 10, the ink-filling member 22 is fixedly mounted on the printing assembly 21. The fourth connecting portions 221 of the ink-filling member 22 respectively engage with the third connecting portions 253 of the top frame 25 to connect the ink-filling member 22 with the top frame 25. The ink-filling member 22 and the printing assembly 21 are further mounted on the retaining seat 10, and then the spring 30 and the retainer 26 are further mounted on the moving seat 20. The handle 40 is mounted on the moving seat 20. The bottom cover 50 is mounted on the retaining seat 10. The combination of the stamp is finished.

The printing face 241 of the printing element 24 may be stamped on a sheet of paper. The paper shows patterns or characters formed on the printing face 241. The paper may be deposited in the concavity 43 of the handle 40. The top cover 42 is transparent and covers the paper in the concavity 43. It is convenient to show the patterns or the characters stamped on the paper.

Accordingly, the top frame 25, the printing element 24, and the bottom frame 23 may combine to form the printing assembly 21. The printing assembly 21 can be used to test print. Since the caliber of each one of the ink-filling holes 251 of the printing assembly 21 is larger than the caliber of each one of the ink-filling tubes 222 of the ink-filling member 22, the osmosis efficiency of ink filled via the ink-filling holes 251 is better than the osmosis efficiency of ink filled via the ink-filling tubes 222. The waiting time for the osmosis of the ink-absorbing layer 243 via the ink-filling holes 251 is decreased. The combining time of the stamp and the operating time of the test print are decreased.

The invention claimed is:

1. A stamp comprising:
- a retaining seat;
- a moving seat moveably mounted in the retaining seat and having
  - a printing assembly having
    - a bottom frame having
      - a bottom surface;
      - an outer surface of the bottom frame formed around the bottom surface of the bottom frame;
      - an opening formed through the bottom surface of the bottom frame; and
      - multiple first connecting portions formed on the outer surface of the bottom frame at spaced intervals;
    - a printing element mounted in the bottom frame and having
      - a printing face formed on the printing element and extending out of the bottom frame via the opening of the bottom frame; and
    - a top frame mounted on the bottom frame and having
      - a top surface;
      - an outer surface of the top frame formed around the top surface of the top frame;
      - multiple ink-filling holes formed on the top surface of the top frame above the printing element, and each one of the ink-filling holes having a caliber;
      - multiple second connecting portions formed on and protruding from the outer surface of the top frame and respectively engaging with the first connecting portions of the bottom frame; and
      - multiple third connecting portions formed on the outer surface of the top frame at spaced intervals; and
  - an ink-filling member mounted on the printing assembly and having
    - a top surface;
    - an outer surface of the ink-filling member formed around the top surface of the ink-filling member;
    - multiple fourth connecting portions formed on the outer surface of the ink-filling member and respectively engaging with the third connecting portions of the top frame; and
    - multiple ink-filling tubes formed on and protruding from the top surface of the ink-filling member above the ink-filling holes and communicating with the ink-filling holes of the printing assembly, and each one of the ink-filling tubes having
      - a caliber smaller than the caliber of each one of the ink-filling holes;
- a spring mounted on the moving seat and abutting the retaining seat;
- a handle mounted on the moving seat and extending around the retaining seat; and
- a bottom cover mounted on a bottom of the retaining seat.

2. The stamp as claimed in claim 1, wherein the top frame has two reinforcing ribs respectively deposited in the ink-filling holes of the top frame.

3. The stamp as claimed in claim 2, wherein
- the printing element has
  - a block mounted on the bottom frame, facing the opening of the bottom frame, and having a top surface and a bottom surface; and
  - an ink-absorbing layer mounted on the top surface of the block and facing the ink-filling holes of the top frame; and
- the printing face is formed on the bottom surface of the block.

4. The stamp as claimed in claim 3, wherein
- the retaining seat has
  - a shell;
  - multiple gateways formed through the shell;
  - a plate formed in the shell and located between the gateways; and
  - a through hole formed through the plate;
- the ink-filling tubes of the ink-filling member are respectively inserted through the gateways of the retaining seat;

the ink-filling member has a cylinder formed on the top surface of the ink-filling member between the ink-filling tubes and inserted through the through hole of the retaining seat; and a retainer mounted on a distal end of the cylinder; and the spring is mounted around the cylinder and has two ends respectively abutting the plate of the retaining seat and the retainer of the ink-filling member.

5. The stamp as claimed in claim 4, wherein the handle has a body mounted on the moving seat and having a top surface; and a concavity formed on the top surface of the body; and a top cover mounted on the body and covering the concavity of the body.

6. The stamp as claimed in claim 3, wherein the handle has a body mounted on the moving seat and having a top surface; and a concavity formed on the top surface of the body; and a top cover mounted on the body and covering the concavity of the body.

7. The stamp as claimed in claim 2, wherein the retaining seat has a shell;

multiple gateways formed through the shell;

a plate formed in the shell and located between the gateways; and a through hole formed through the plate;

the ink-filling tubes of the ink-filling member are respectively inserted through the gateways of the retaining seat;

the ink-filling member has a cylinder formed on the top surface of the ink-filling member between the ink-filling tubes and inserted through the through hole of the retaining seat; and a retainer mounted on a distal end of the cylinder; and the spring is mounted around the cylinder and has two ends respectively abutting the plate of the retaining seat and the retainer of the ink-filling member.

8. The stamp as claimed in claim 7, wherein the handle has a body mounted on the moving seat and having a top surface; and a concavity formed on the top surface of the body; and a top cover mounted on the body and covering the concavity of the body.

9. The stamp as claimed in claim 2, wherein the handle has a body mounted on the moving seat and having a top surface; and a concavity formed on the top surface of the body; and a top cover mounted on the body and covering the concavity of the body.

10. The stamp as claimed in claim 1, wherein the printing element has a block mounted on the bottom frame, facing the opening of the bottom frame, and having a top surface and a bottom surface; and an ink-absorbing layer mounted on the top surface of the block and facing the ink-filling holes of the top frame; and the printing face is formed on the bottom surface of the block.

11. The stamp as claimed in claim 10, wherein the retaining seat has a shell;

multiple gateways formed through the shell;

a plate formed in the shell and located between the gateways; and a through hole formed through the plate;

the ink-filling tubes of the ink-filling member are respectively inserted through the gateways of the retaining seat;

the ink-filling member has a cylinder formed on the top surface of the ink-filling member between the ink-filling tubes and inserted through the through hole of the retaining seat; and a retainer mounted on a distal end of the cylinder; and the spring is mounted around the cylinder and has two ends respectively abutting the plate of the retaining seat and the retainer of the ink-filling member.

12. The stamp as claimed in claim 11, wherein the handle has a body mounted on the moving seat and having a top surface; and a concavity formed on the top surface of the body; and a top cover mounted on the body and covering the concavity of the body.

13. The stamp as claimed in claim 10, wherein the handle has a body mounted on the moving seat and having a top surface; and a concavity formed on the top surface of the body; and a top cover mounted on the body and covering the concavity of the body.

14. The stamp as claimed in claim 1, wherein the retaining seat has a shell;

multiple gateways formed through the shell;

a plate formed in the shell and located between the gateways; and a through hole formed through the plate;

the ink-filling tubes of the ink-filling member are respectively inserted through the gateways of the retaining seat;

the ink-filling member has a cylinder formed on the top surface of the ink-filling member between the ink-filling tubes and inserted through the through hole of the retaining seat; and a retainer mounted on a distal end of the cylinder; and the spring is mounted around the cylinder and has two ends respectively abutting the plate of the retaining seat and the retainer of the ink-filling member.

15. The stamp as claimed in claim 14, wherein the handle has a body mounted on the moving seat and having a top surface; and a concavity formed on the top surface of the body; and a top cover mounted on the body and covering the concavity of the body.

16. The stamp as claimed in claim 1, wherein the handle has a body mounted on the moving seat and having a top surface; and a concavity formed on the top surface of the body; and a top cover mounted on the body and covering the concavity of the body.

* * * * *